US008707630B1

(12) United States Patent
Jhaveri et al.

(10) Patent No.: US 8,707,630 B1
(45) Date of Patent: Apr. 29, 2014

(54) PHARMACY WORKSPACE WITH CLINIC STATION

(75) Inventors: Nimesh S. Jhaveri, Kildeer, IL (US); Archana Dhruve, Bartlett, IL (US); Heather K. Hill, Barrington, IL (US); Dejan Kozic, Wadsworth, IL (US); Laura Jean Tebbe, Antioch, IL (US); Susan G. Heald, Buffalo Grove, IL (US); Warit Tulyathorn, Chicago, IL (US); Mark A. Jones, Evanston, IL (US); Sara B. Frisk, Chicago, IL (US); Jennifer M. Levin, Chicago, IL (US); Jennifer A. Comiskey, Chicago, IL (US); David T. Blanchard, Evanston, IL (US)

(73) Assignee: Walgreen Co., Deerfield, IL (US)

( * ) Notice: Subject to any disclaimer, the term of this patent is extended or adjusted under 35 U.S.C. 154(b) by 0 days.

(21) Appl. No.: 13/286,857

(22) Filed: Nov. 1, 2011

Related U.S. Application Data

(60) Provisional application No. 61/408,960, filed on Nov. 1, 2010.

(51) Int. Cl.
*E04H 3/08* (2006.01)
*E04H 14/00* (2006.01)

(52) U.S. Cl.
USPC ..... 52/36.1; 52/33; 52/79.1; 52/79.8; 52/173.1; 52/234; 186/35; 186/36; 705/2

(58) Field of Classification Search
USPC ..... 52/36.1, 36.4, 79.1, 79.7, 79.8, 234, 52/238.1, 33, 79.6, 173.1, 174, 236.1; 186/35, 36; 705/2
See application file for complete search history.

(56) References Cited

U.S. PATENT DOCUMENTS

| | | | | | |
|---|---|---|---|---|---|
| 1,348,024 | A | * | 7/1920 | McCarty | 52/33 |
| 1,372,095 | A | * | 3/1921 | Shaul | 52/65 |
| 1,404,613 | A | * | 1/1922 | Hormes | 434/72 |
| RE15,368 | E | * | 5/1922 | McCarty | 52/33 |

(Continued)

FOREIGN PATENT DOCUMENTS

EP 1547491 A1 * 6/2005

OTHER PUBLICATIONS

Thrifty debuts new prototype. (Thrifty Drug Stores Inc.), Chain Store Age Executive with Shopping Center Age, v69, n2, p30(1), Feb. 1993 (2 pages).*

*Primary Examiner* — Basil Katcheves
*Assistant Examiner* — Rodney Mintz
(74) *Attorney, Agent, or Firm* — Francis C. Kowalik; Randall G. Rueth; Marshall, Gerstein & Borun LLP

(57) ABSTRACT

A retail pharmacy workspace that has a clinic station where common acute health issues such as the flu and ear infections can be addressed by a medical assistant; boundary walls that at least partially surround the clinic station and include a doorway and a screening wall that has front and back ends and no doorway between those ends; at least one examination room within the boundary walls; a waiting room within the boundary walls, between the examination room and the doorway; a prescription station where prescriptions are filled; a pharmacy waiting area outside the boundary walls of the clinic station; and parallel rows of seating in the pharmacy waiting area that define front and back limits of a seating area that are arranged on lines that intersect the screening wall.

15 Claims, 17 Drawing Sheets

(56) References Cited

U.S. PATENT DOCUMENTS

RE17,178 E * 1/1929 Trapp ..... 52/33
1,717,123 A * 6/1929 Sharp ..... 52/31
1,766,409 A * 6/1930 Stocks ..... 312/42
1,780,102 A * 10/1930 Watt ..... 52/200
1,873,852 A * 8/1932 Rorrer et al. ..... 52/33
2,154,897 A * 4/1939 Grant ..... 52/79.4
2,285,962 A * 6/1942 Foulkes ..... 52/29
2,756,584 A * 7/1956 Shelton ..... 52/236.1
2,823,425 A * 2/1958 Granek ..... 52/65
3,346,997 A * 10/1967 Parrish ..... 52/34
3,437,057 A * 4/1969 Wulff ..... 108/22
3,451,261 A * 6/1969 Olsen ..... 73/116.01
3,606,045 A * 9/1971 Abromavage et al. ..... 414/564
3,623,283 A * 11/1971 Abromavage et al. ..... 52/19
3,696,805 A * 10/1972 Sweeten et al. ..... 600/301
3,732,649 A * 5/1973 Mehran ..... 52/169.3
3,742,932 A * 7/1973 Greenspan ..... 600/21
3,778,911 A * 12/1973 Woolman ..... 434/432
3,789,560 A * 2/1974 Wood ..... 52/236.1
3,879,913 A * 4/1975 Clark ..... 52/741.1
3,897,855 A * 8/1975 Patterson ..... 312/209
3,911,900 A * 10/1975 Shoen et al. ..... 600/301
3,922,788 A * 12/1975 Rota ..... 433/33
4,074,793 A * 2/1978 Yuter ..... 186/38
4,095,379 A * 6/1978 Weintraub ..... 52/29
4,116,509 A * 9/1978 Smith ..... 312/107
4,154,027 A * 5/1979 Searcy ..... 52/33
4,259,816 A * 4/1981 Bergquist ..... 52/33
4,274,233 A * 6/1981 Currier ..... 52/33
D260,709 S * 9/1981 Perlmutter ..... D6/470
4,288,948 A * 9/1981 Harris ..... 52/28
D262,926 S * 2/1982 Woolford ..... D6/471
4,359,843 A * 11/1982 Schachar ..... 52/29
4,663,895 A * 5/1987 Brice ..... 52/33
4,821,469 A * 4/1989 Bayless ..... 52/33
4,823,523 A * 4/1989 Coupard et al. ..... 52/3
4,841,692 A * 6/1989 Coupard et al. ..... 52/3
5,039,616 A * 8/1991 Copelan ..... 436/56
5,133,935 A * 7/1992 Copelan ..... 422/430
5,193,648 A * 3/1993 Yuter ..... 186/38
5,355,395 A * 10/1994 Kenneth et al. ..... 376/216
5,511,594 A * 4/1996 Brennan et al. ..... 141/98
5,597,995 A * 1/1997 Williams et al. ..... 235/375
5,622,010 A * 4/1997 Weber ..... 52/36.4
D386,327 S * 11/1997 Rotchin ..... D6/470
5,775,033 A * 7/1998 Meehan ..... 52/33
5,782,045 A * 7/1998 Paschal ..... 52/220.8
5,806,260 A * 9/1998 Quaintance ..... 52/236.3
5,809,708 A * 9/1998 Greer et al. ..... 52/220.7
5,878,535 A * 3/1999 Green ..... 52/33
6,082,799 A * 7/2000 Marek ..... 296/24.38
6,141,924 A * 11/2000 Quaintance ..... 52/236.3
6,179,358 B1 * 1/2001 Hirayama et al. ..... 296/24.38
6,196,648 B1 * 3/2001 Henriott ..... 312/196
6,205,716 B1 * 3/2001 Peltz ..... 52/36.2
6,243,993 B1 * 6/2001 Swensson ..... 52/79.5
6,256,936 B1 * 7/2001 Swensson et al. ..... 52/35
6,360,494 B1 * 3/2002 Emerson ..... 52/106
6,415,555 B1 * 7/2002 Montague ..... 52/36.2
6,588,548 B1 * 7/2003 Dewitt ..... 186/2
6,748,704 B2 * 6/2004 Eguchi et al. ..... 52/79.1
6,944,996 B1 * 9/2005 Rowe ..... 52/236.1
6,970,144 B1 * 11/2005 Swift et al. ..... 345/1.1
7,143,050 B2 * 11/2006 Crane ..... 705/2
7,174,678 B2 * 2/2007 Gallant ..... 52/36.1
7,269,925 B2 * 9/2007 Lam ..... 52/79.1
D553,128 S * 10/2007 Murphy ..... D14/305
7,320,200 B1 * 1/2008 Eisner ..... 52/236.1
7,454,868 B2 * 11/2008 Clark ..... 52/243.1
7,537,030 B2 * 5/2009 Gallant ..... 141/18
7,540,546 B2 * 6/2009 Kern et al. ..... 296/19
7,653,557 B2 * 1/2010 Sweetser ..... 705/3
7,860,724 B2 * 12/2010 Chudy et al. ..... 705/2
7,895,797 B2 * 3/2011 Bridgman et al. ..... 52/174
7,992,355 B2 * 8/2011 Bridgman et al. ..... 52/174
8,006,804 B2 * 8/2011 Coleman et al. ..... 186/38
8,069,618 B2 * 12/2011 Larsson ..... 52/79.8
8,097,451 B2 * 1/2012 Gaalswyk ..... 435/289.1
8,112,942 B2 * 2/2012 Bohm et al. ..... 52/79.1
8,215,065 B2 * 7/2012 Gallant ..... 52/36.1
8,341,899 B2 * 1/2013 Solomon et al. ..... 52/234
8,352,176 B2 * 1/2013 Kaldewey et al. ..... 701/409
8,402,699 B2 * 3/2013 Henriott ..... 52/36.1
D687,644 S * 8/2013 Jhaveri et al. ..... D6/686
8,533,927 B2 * 9/2013 Atherton et al. ..... 29/464
8,571,886 B2 * 10/2013 Chudy et al. ..... 705/2
8,584,349 B2 * 11/2013 Scannon et al. ..... 29/722
8,621,786 B2 * 1/2014 Lam ..... 52/33
2002/0046518 A1 * 4/2002 Eguchi et al. ..... 52/220.1
2002/0138367 A1 * 9/2002 Meurer ..... 705/27
2003/0019165 A1 * 1/2003 Gallant et al. ..... 52/36.4
2003/0131545 A1 * 7/2003 Kishimoto ..... 52/174
2003/0136066 A1 * 7/2003 Kishimoto et al. ..... 52/239
2003/0177721 A1 * 9/2003 Wong ..... 52/234
2003/0195768 A1 * 10/2003 Taylor ..... 705/2
2003/0213184 A1 * 11/2003 Hunt et al. ..... 52/36.1
2004/0088187 A1 * 5/2004 Chudy et al. ..... 705/2
2004/0111290 A1 * 6/2004 Crane ..... 705/2
2004/0111295 A1 * 6/2004 Crane ..... 705/2
2004/0159051 A1 * 8/2004 Lam ..... 52/79.1
2004/0172887 A1 * 9/2004 Moglin et al. ..... 52/36.1
2004/0186744 A1 * 9/2004 Lux ..... 705/2
2005/0138867 A1 * 6/2005 Zhao ..... 52/79.1
2005/0273343 A1 * 12/2005 Coleman et al. ..... 705/1
2005/0277872 A1 * 12/2005 Colby et al. ..... 604/67
2005/0279035 A1 * 12/2005 Donovan ..... 52/79.1
2005/0288571 A1 * 12/2005 Perkins et al. ..... 600/407
2006/0004605 A1 * 1/2006 Donoghue et al. ..... 705/2
2006/0143997 A1 * 7/2006 Libenson ..... 52/234
2007/0000185 A1 * 1/2007 DeLine ..... 52/33
2007/0039253 A1 * 2/2007 Snowden ..... 52/79.1
2007/0074471 A1 * 4/2007 Gallagher ..... 52/236.3
2007/0125008 A1 * 6/2007 Gallant ..... 52/36.4
2007/0204527 A1 * 9/2007 Clark ..... 52/79.1
2007/0252003 A1 * 11/2007 Goldring et al. ..... 235/381
2007/0260473 A1 * 11/2007 Cornacchia ..... 705/1
2008/0012936 A1 * 1/2008 White ..... 348/14.16
2008/0098666 A1 * 5/2008 Larsson ..... 52/79.11
2008/0127574 A1 * 6/2008 Yi ..... 52/8
2008/0221919 A1 * 9/2008 Cates ..... 705/2
2008/0313973 A1 * 12/2008 Butler Rolf ..... 52/79.1
2009/0025321 A1 * 1/2009 Cherney et al. ..... 52/238.1
2009/0126285 A1 * 5/2009 Suh et al. ..... 52/79.1
2009/0249708 A1 * 10/2009 Zschornack et al. ..... 52/79.9
2009/0255195 A1 * 10/2009 Bridgman et al. ..... 52/174
2009/0292465 A1 * 11/2009 Kaldewey et al. ..... 701/209
2010/0013812 A1 * 1/2010 Gu et al. ..... 345/207
2010/0238265 A1 * 9/2010 White ..... 348/14.16
2010/0324380 A1 * 12/2010 Perkins et al. ..... 600/301
2011/0041434 A1 * 2/2011 Solomon et al. ..... 52/234
2011/0120035 A1 * 5/2011 Staebler ..... 52/234
2011/0173898 A1 * 7/2011 Denicourt et al. ..... 52/79.1
2011/0191269 A1 * 8/2011 Weis et al. ..... 705/500
2011/0209415 A1 * 9/2011 Lowes et al. ..... 52/1
2013/0025221 A1 * 1/2013 Mouzannar ..... 52/234
2013/0111825 A1 * 5/2013 Lefkus et al. ..... 52/79.1
2013/0192153 A1 * 8/2013 Kobe et al. ..... 52/234
2013/0219807 A1 * 8/2013 Elliott et al. ..... 52/79.1

* cited by examiner

Walgreens up next 4:07 p.m prescription pick-up

| NAME | APPROX WAIT TIME |
|---|---|
| **Karen T.** | **ready** |
| **Melissa M.** | **ready** |
| **George B.** | **1 minutes** |
| Jordan D. | 2 minutes |
| Don P. | 4 minutes |
| Carlos M. | 6 minutes |
| Jennifer E. | 8 minutes |

pharmacist consultation

| NAME | APPROX WAIT TIME |
|---|---|
| **Jenny M.** | **5 minutes** |
| Mike J. | 10 minutes |
| Odessa A. | 23 minutes |
| Zena C. | 25 minutes |

take care clinic

| NAME | APPROX WAIT TIME |
|---|---|
| **Ron S.** | **15 minutes** |
| Adam K. | 20 minutes |
| Frank C. | 30 minutes |

*FIG. 8*

Walgreens health explorer

June 20, 2010

Good information leads to good health. Tap on a topic to learn more.

Learn more about our upcoming community health events.

Community Health

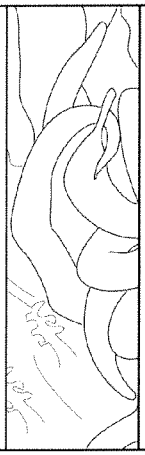

WEDNESDAY
July 7, 2010
You Are What You Eat
This community health event features helpful information about local farmers markets as well as quick tips about cooking, nutrition, and gardening. Because there's a lot of truth to the saying: "you are what you eat!"
5:00 - 7:00 p.m.
Community Corner
Explore All Events >

Discover our full range of health and wellness services.

Screenings

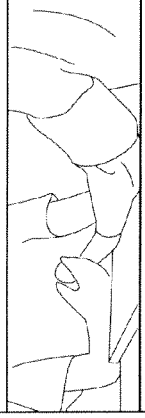

WALK-IN ANYTIME
Cholesterol Screenings
Our quick tests are used to assess risks of heart disease, metabolic syndrome, and diabetes. Participants are required to fast for at least 2 to 4 hours before the test. Results are available within five minutes.
Ask our Health Guide for help signing up.
Explore All Services >

PERKS
Find out how to reward yourself for healthy choices.

Health Points

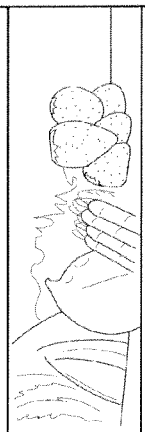

Get Rewarded for Purchasing Healthy Groceries.
Rack up Health Points when you purchase vitamins and healthy groceries. You redeem your points for gifts or money off your prescriptions.
Ask our Health Guide for more information.
Explore All Perks >

FIG. 10

Walgreens community corner

June 20, 2010

| | SUN | MON | TUE | WED | THU | FRI | SAT |
|---|---|---|---|---|---|---|---|
| JUNE | 20<br>**Walgreens Walkers**<br>7:00 p.m.<br>**Smoking Cessation Class**<br>6:00 p.m. | 21 | 22 | 23 | 24<br>**Weight Watchers Group Meeting**<br>Chicago Group 118<br>6:00 p.m. | 25 | 26 |
| | 27 | 28 | 29<br>**Sport Camp Check-ups**<br>11:00 a.m. - 4:30 p.m. | 30 | 1 | 2<br>**American Red Cross Blood Drive**<br>9:00 a.m. - 4:30 p.m. | 3 |
| JULY | 4<br>**Managing Back Pain**<br>3:00 p.m. | 5 | 6 | 7<br>**You Are What You Eat!**<br>5:00 p.m. - 7:00 p.m. | 8 | 9 | 10 |
| | 11 | 12<br>**Caring for Your Newborn**<br>7:00 p.m. | 13 | 14 | 15<br>**Cholesterol Screening**<br>6:30 p.m. | 16<br>**Managing Seasonal Allergies**<br>6:30 p.m. | 17 |

COMING SOON

July 7, 2010

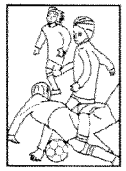

Sport Camp Check-ups

Need text here

11:00 a.m. - 4:30 p.m.
Chicago Y.M.C.A.

For more information or to register for an event, please see our health guide.

*FIG. 16*

PHARMACY WORKSPACE WITH CLINIC STATION

CROSS-REFERENCE TO RELATED APPLICATIONS

The present application claims the benefit of U.S. Provisional Patent Application No. 61/61/408,960 filed Nov. 1, 2010, the disclosure of which is incorporated herein by reference in its entirety for all purposes.

BACKGROUND OF THE INVENTION

The present invention relates generally to pharmacy services, and more particularly to a new retail workspace where pharmacy services are provided. When it comes to health care, consumers prefer to listen to trusted sources. People often look to friends or neutral parties rather than to medical experts.

Most consumers are self-reliant about health issues. When people encounter a health issue that requires them to make a decision or take action, they like to turn to a variety of resources and make the decision on their own terms, for example by self-diagnosis and searching not only for the answers provided by traditional medicine, but also for alternatives.

Catalysts such as a health crisis or event, an inspiring role model, changes in social milieu, or a trusted source can change attitudes about health care, increasing the belief that action is needed. Reinforcers such as incentives, social support, easy access, and recognition of progress can help drive that action.

It is believed that health care service can be improved by:

- relating health care services in to the rhythm of the customer's life;
- showing the customer that a range of health services are offered;
- offering options for how the customer interacts with the provider; and
- providing a simplified, light-touch experience.

BRIEF SUMMARY

The applicants have developed a new pharmacy workspace in which customers are more likely to feel comfortable in obtaining a wider range of health care services.

Like some prior retail pharmacy workspaces, the new workspace has not only a prescription station where prescriptions are filled, but also a clinic station that includes an examination room where a medical assistant can address common acute health issues such as the flu and ear infections. The clinic station is at least partially surrounded by boundary walls that include a doorway.

To help alleviate potential concerns that visiting a prescription desk near a location where acute health issues are treated could lead to exposure to a communicable disease, the new workspace has a pharmacy waiting area outside the boundary walls of the clinic station, and a separate clinic waiting room within the boundary walls. The pharmacy waiting area has parallel rows of seating that define front and back limits of a pharmacy seating area. Those rows are arranged on lines that intersect a screening wall that is positioned between the interior of the clinic station and the pharmacy seating area. The screening wall has front and back ends and no doorway between those ends, and serves to screen the two waiting areas from each other.

A central reception desk may be positioned between the clinic station and the prescription station, and be separated from the clinic station by only an open circulation area. The doorway to the clinic station may face the reception desk. Overhead displays above the reception desk can be arranged to face the clinic station, the pharmacy waiting area, and the prescription station, and can be used to display waiting times for both prescriptions and for services in the clinic station.

The medical assistant can be seated in a nook within the clinic waiting room. The nook can be bounded by part of the screening wall and by a nook wall that extends from one side of the doorway. A waiting room wall can extend from the other side of the doorway, and that wall can form one boundary of a patient seating area in the waiting room where clinic patients can sit. A window can be provided in the clinic waiting room wall, extending from an upper part of the doorway and facing the open circulation area. The window can be at least partially covered by a non-opaque divider.

Video-conferencing equipment can also be provided within the clinic station, enabling a customer to communicate with an off-site medical specialist. A touchscreen device can also be used there, and be programmed to use the data associated with a customer to tailor specific product and service recommendations for that customer.

BRIEF DESCRIPTION OF THE DRAWINGS

The invention may be better understood by referring to the accompanying drawings, in which:

FIG. 8 is an example of a screen display that may be presented on a display in the workspace.

FIG. 10 is an example of another screen display that can be displayed on a touchscreen device in the workspace.

FIG. 16 is an example of another screen display that may be presented on a display in the workspace.

DETAILED DESCRIPTION

Figure 1:
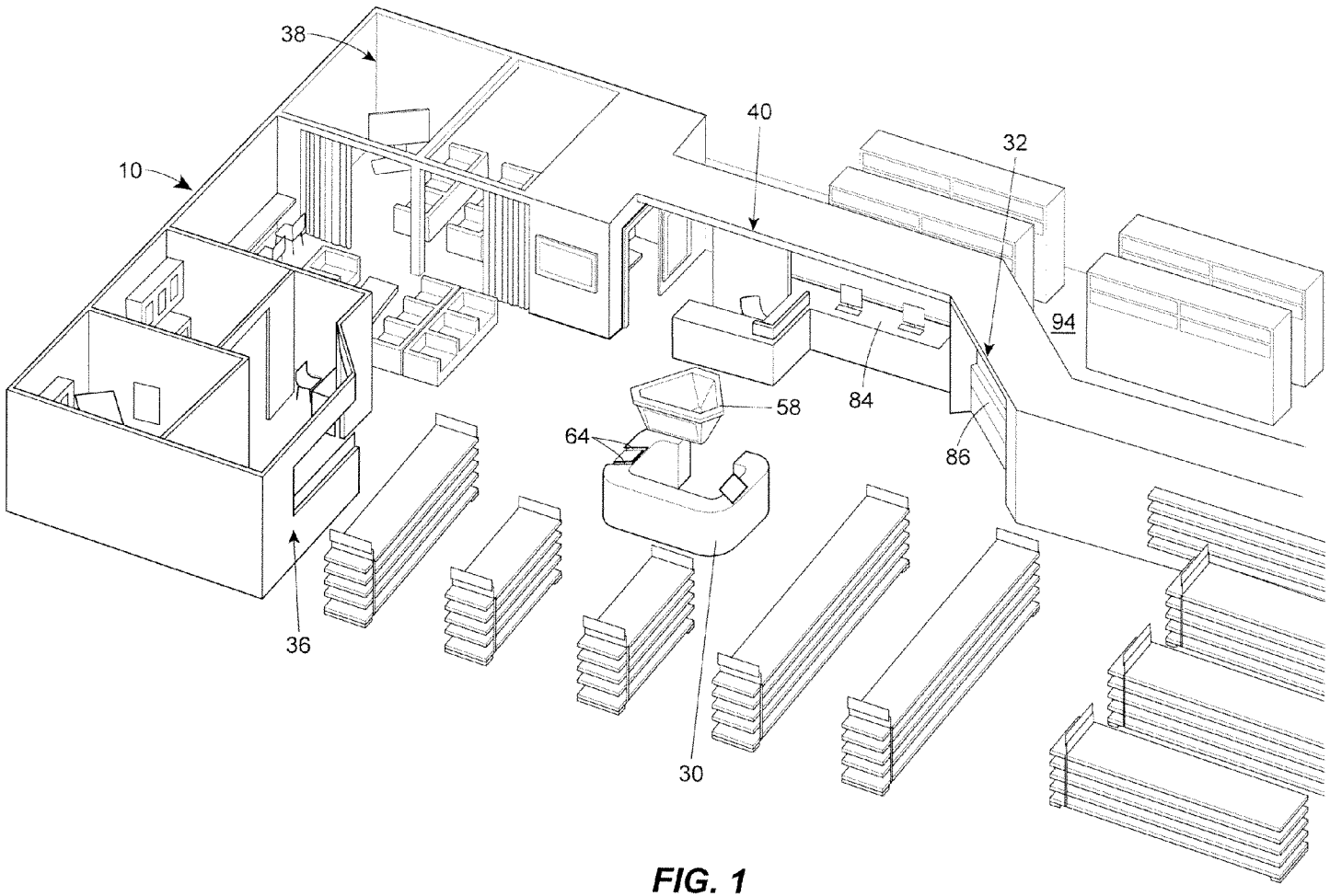
FIG. 1 is a perspective view of one embodiment of the new pharmacy workspace.
Figure 2:
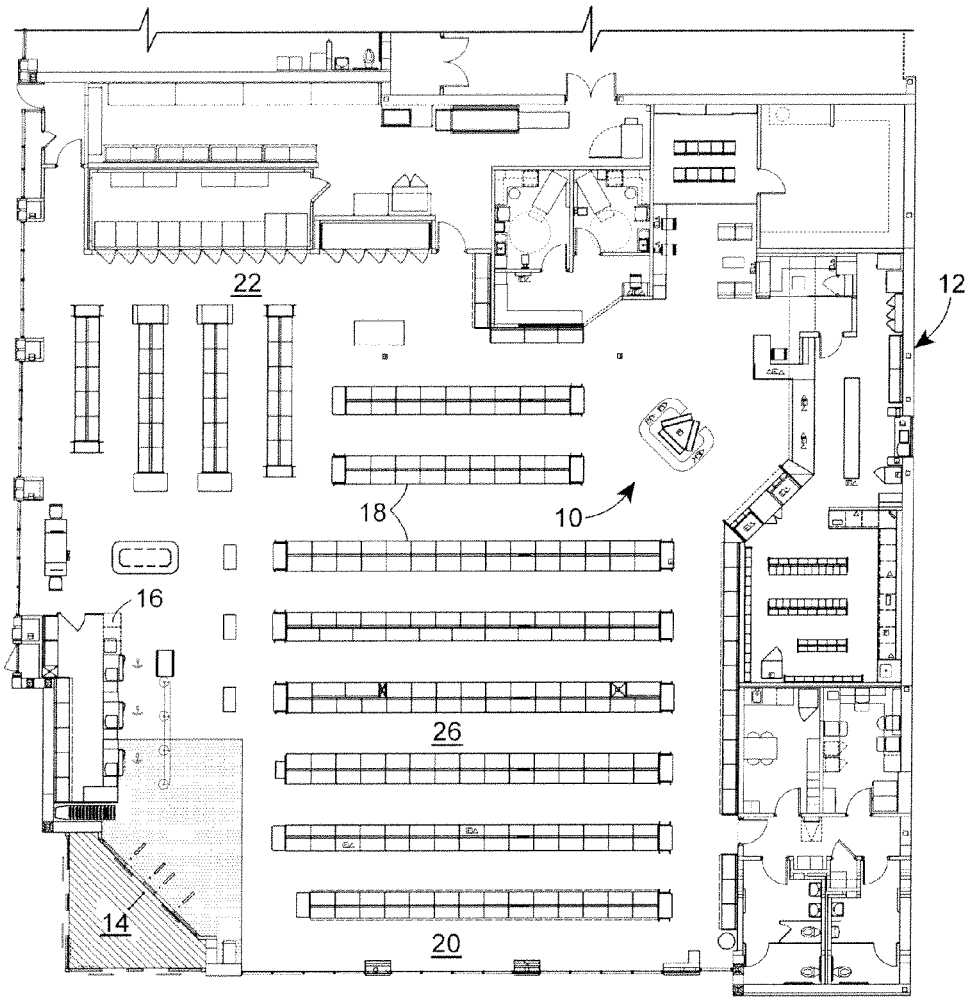
FIGS. 2 and 3 are floor plans of two stores that use embodiments of the new pharmacy workspace.
Figure 3:
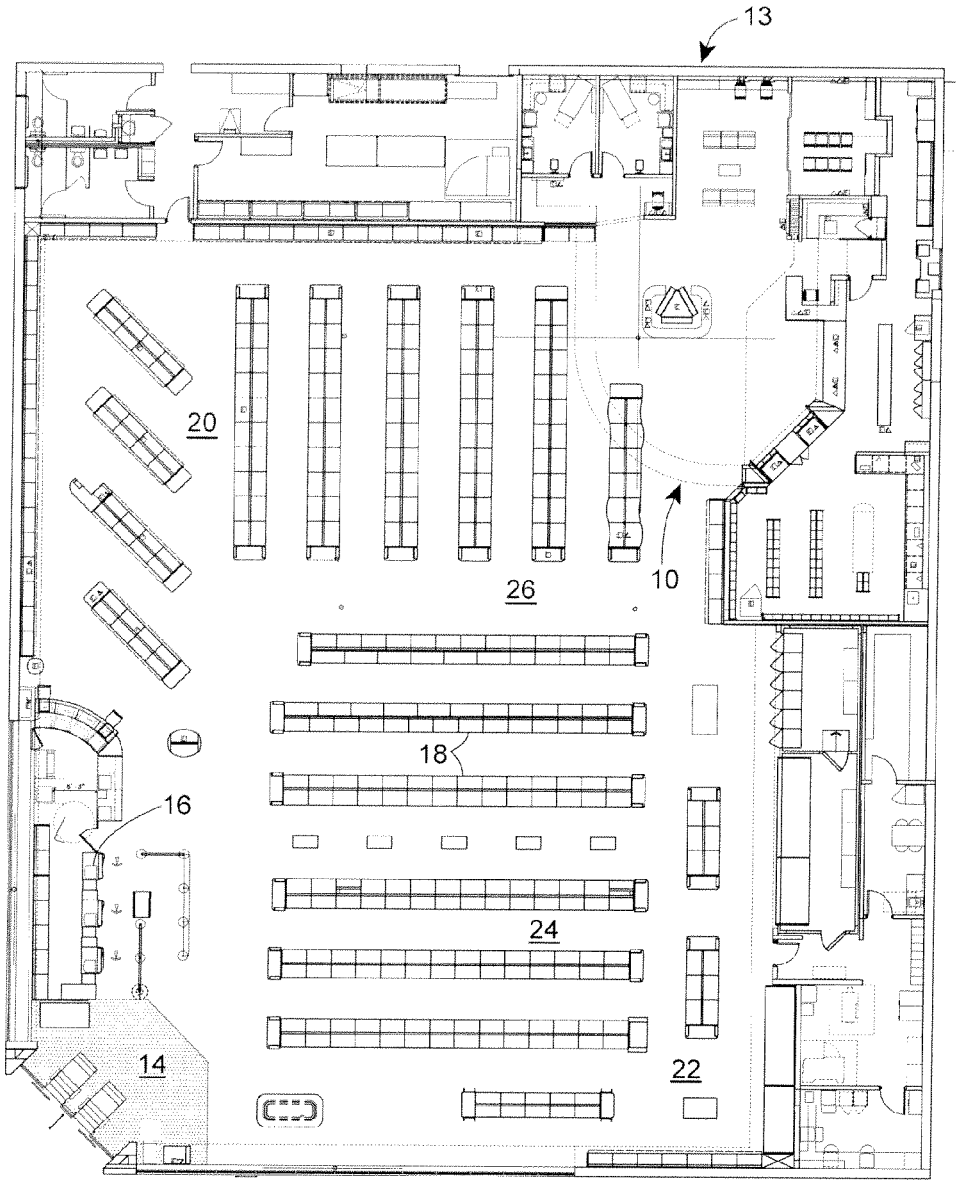

The pharmacy workspace 10 seen in FIG. 1 is one embodiment of a workspace that can be used in a drug store or the like to provide pharmacy services to customers. FIGS. 2 and 3 are floor plans of drug stores 12 and 13 that use embodiments of the workspace. The store 12 seen in FIG. 2 is smaller than the one seen in FIG. 3. Each illustrated store has a front corner vestibule 14 where customers enter and exit the store, a row 16 of check-out counters where customers can pay for their purchases, and shelving 18 for merchandise. As is customary in the trade, similar products can be stocked together, for example with beauty products in a beauty section 20, food items in a food section 22, home products in a home section 24 (FIG. 3), and other products in a general section 26. In these examples, the pharmacy workspace 10 is positioned in a back corner of the store. Positioning the pharmacy workspace away from the vestibule gives customers a chance to see a variety of products as they walk through the store to the pharmacy workspace.

Figure 4:
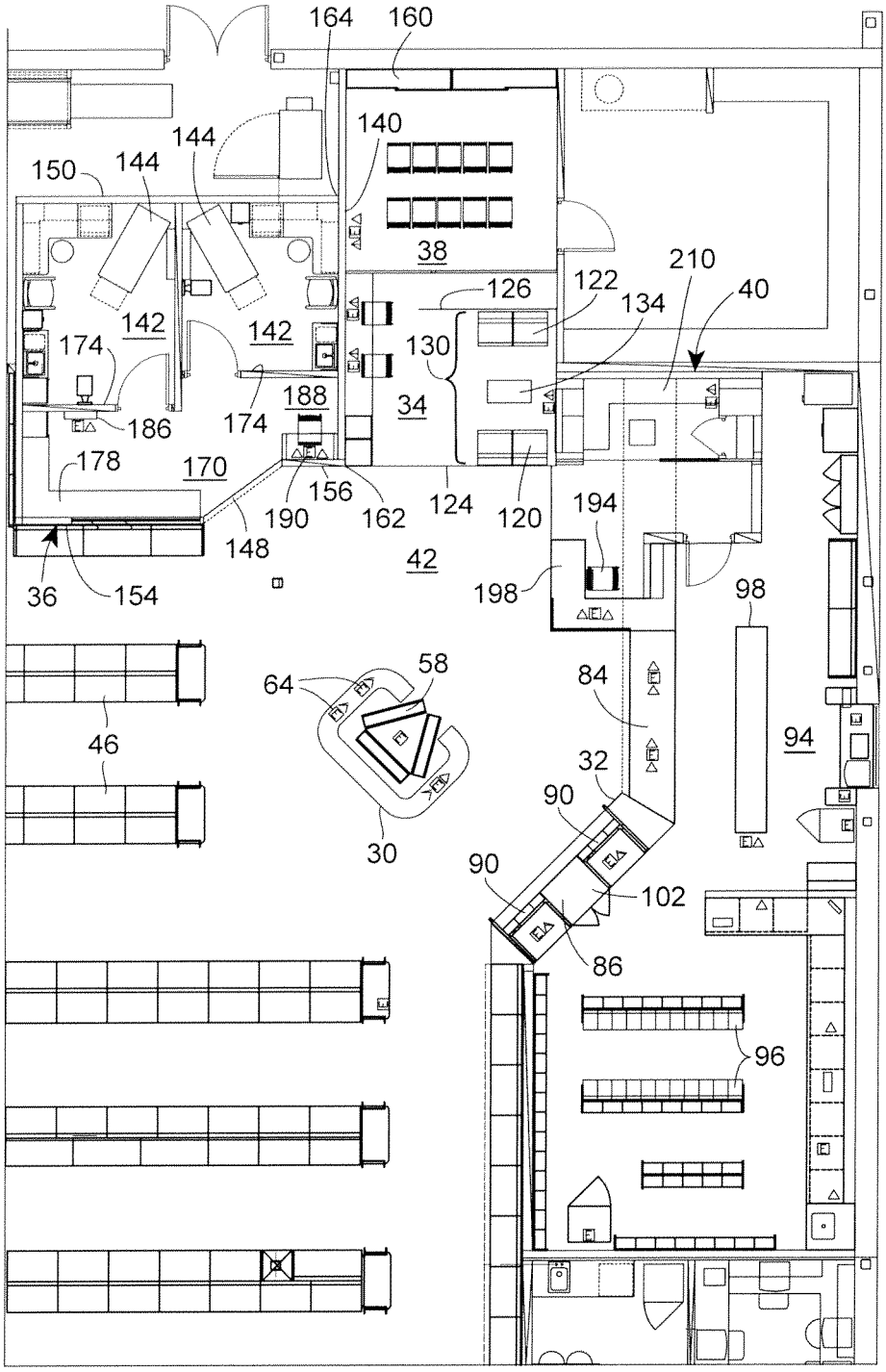
FIGS. 4 and 5 are enlarged fragmentary views of the floor plans seen in FIGS. 2 and 3.
Figure 5:
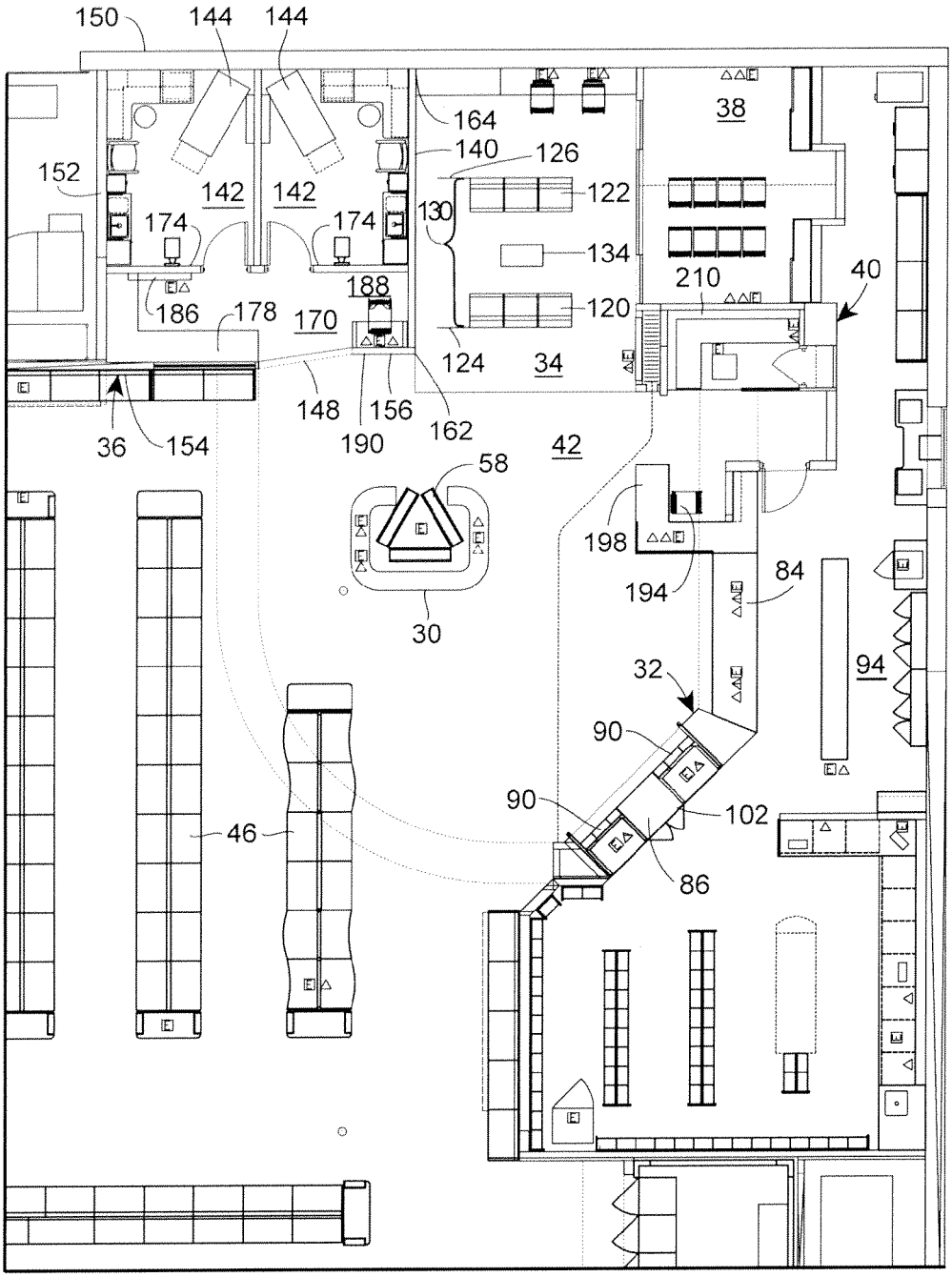

The pharmacy workspaces 10 seen in FIGS. 4 and 5 each have a reception desk 30, a prescription station 32, a pharmacy waiting area 34, a clinic station 36, a flexible workspace 38, and a pharmacist station 40. Each of the stations is accessible to the public and is separated from the reception desk by an open circulation area 42, such that the pharmacy waiting area is in direct line-of-sight of the prescription station, and the central reception desk is within direct line-of-sight of both the prescription station and seating in the pharmacy waiting area. Gondolas 46 join the pharmacy workspace with the rest of the store, and are stocked with goods. Touchscreen devices, including a portable "health tablet," are also used in the workspace.

The Reception Desk

The reception desk 30 serves as a welcoming position within the pharmacy workspace 10. An employee "health guide" may be stationed there, providing the hub of the customer's experience and offering personal and digital resources that will help customers discover new services, find the answers to product questions, check-in for services, and sign-up for events.

The health guide is preferably a senior technician who is adept at customer interaction, knows the suite of services available at the store, and has a good knowledge of health issues. It is the role of the health guide to welcome customers, to answer health care questions, and to provide information about health care services and options.

It is preferred that the reception desk 30 be separated from the prescription station 32, the pharmacist station 40, and the clinic station 36 by only the open circulation area 42. Such an arrangement helps to reinforce the impression of a curated, organized environment, and provides good visibility of the health options that are available to the customer.

Figure 6:
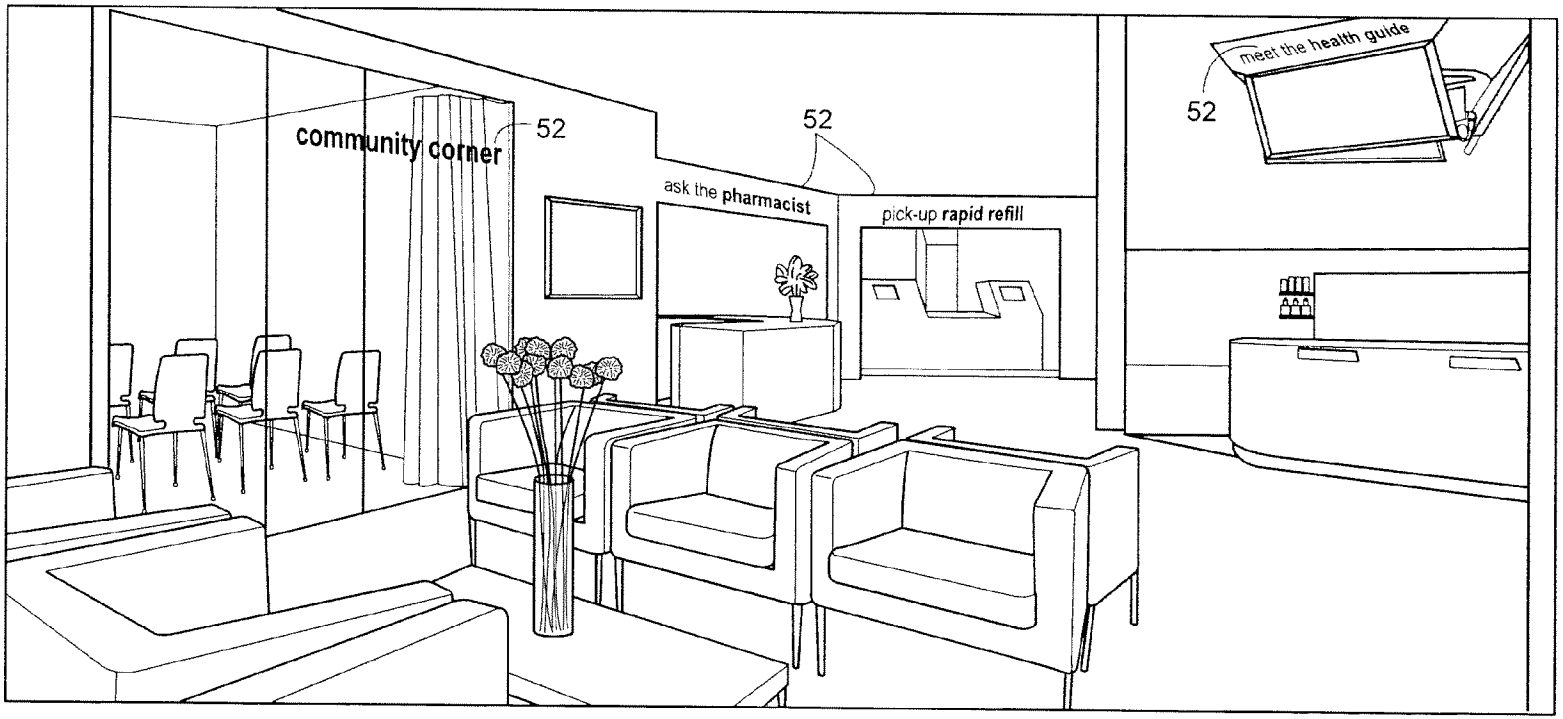
FIG. 6 is a customer-level perspective view of a part of the new workspace.

As seen in FIG. 6, each station in the illustrated workspace 10 is marked with coordinating signage 52 that states the purpose of that station. Coordinated signage helps customers recognize the relationship between the various stations and helps to set customer expectations about the services being offered. In addition, large conversational statements may be provided in key areas. For example, the pharmacist station 40 seen in FIG. 7 includes a prominent statement 54 that reinforces a favorable reputation of the pharmacists at the store, helps to build customer trust, and encourages direct contact.

Overhead displays 58 provide continuously updated information about where customers falls in the queue for services, for example, waiting times for both prescriptions and for services in the clinic station 36. In the example seen in FIG. 1, these displays take the form of three large flat screen displays arranged in a triangular configuration over the reception desk 30. FIG. 8 is a sample screen display that can be used to show waiting times.

The Touchscreen Devices

Figure 9:
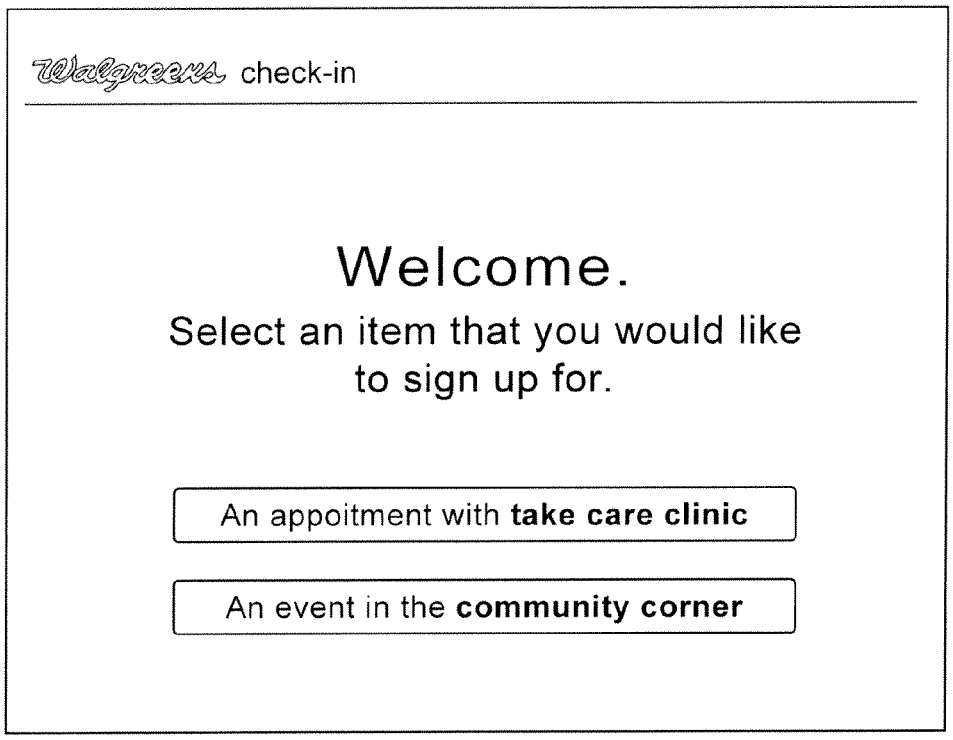
FIG. 9 is a screen display for customer check-ins.

As seen in FIGS. 1, 4, and 5, two fixed kiosks 64 are mounted at the illustrated reception desk 30. These kiosks include touchscreen devices that customers can use to check in for services to be provided at the clinic station 36 or for community health care events to be conducted in the flexible workspace 38. An example of an initial screen display that presents these options is seen in FIG. 9. A separate portable touchscreen device, called a health tablet, can also be provided and used by the health guide to enhance consultations with customers by providing personal profiles, medication guidance, suggested healthy goal-setting, and in-depth information about community events, news, and pharmacy programs.

The store's computer system may be programmed to use the touchscreen devices at the kiosks 64 to provide customers with health care information. The information may be categorized in categories such as news, events, products, services, and perks. In the example seen in FIG. 10, one of the touchscreen devices 64 organizes topics under the categories of events, services, and "perks." Under a "perks" program, customers are given points for purchasing vitamins and healthy groceries. The points can be redeemed for gifts or money off prescriptions. The computer system may also be programmed to use the touchscreen devices to provide the customer with third party health recommendations. These recommendations can include, for example, government or health officials' general recommendations about diet or exercise.

Figure 11:
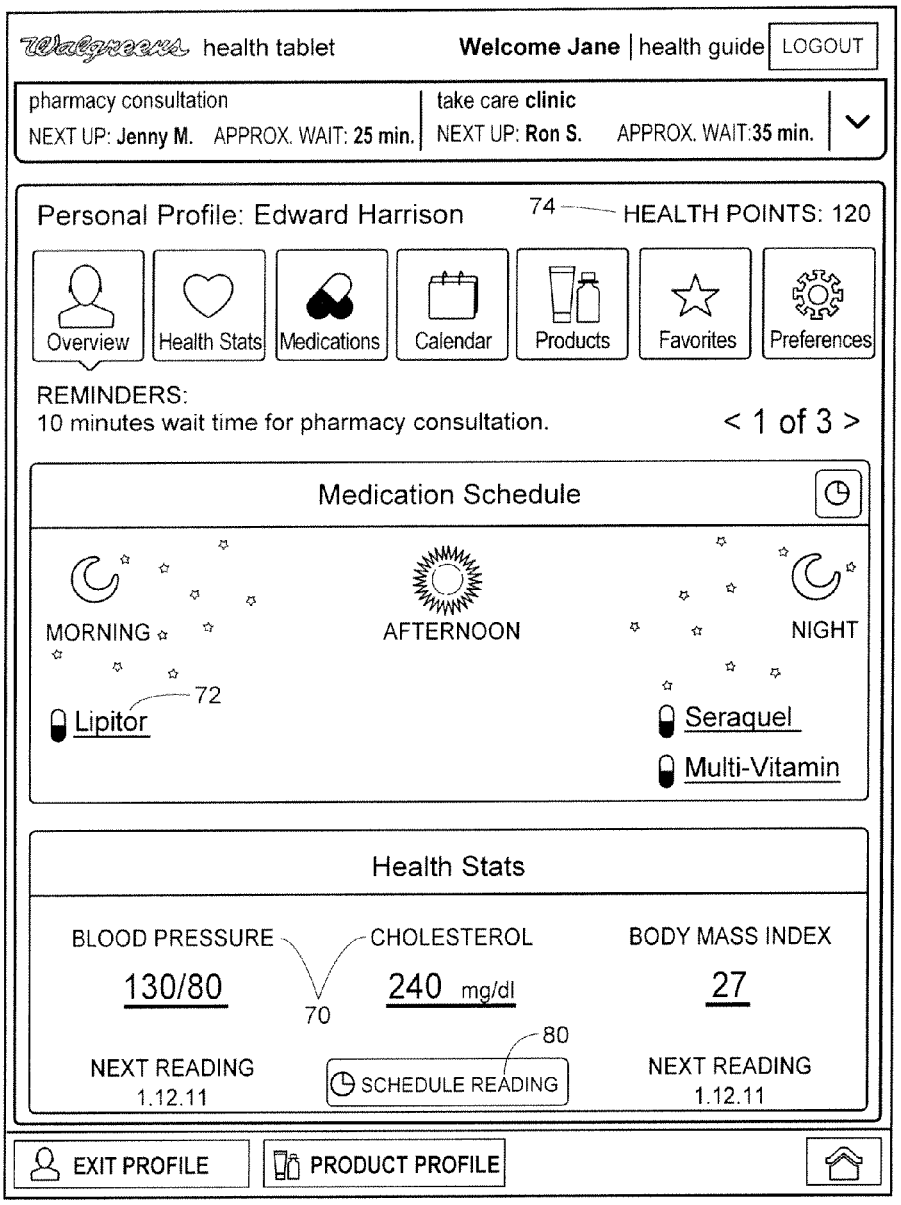
FIG. 11 is an example of a personal profile that can be displayed on the touchscreen device.

If a customer has a specific health care question, then the health guide can use a portable touchscreen device to bring up the customer's profile, look up drug interactions, and research products that the customer might wish to consider. A customer can be identified in the organization's computer records in any of the many well-known ways, such as by swiping an identification card or entering the customer's name or telephone number. As seen in FIG. 11, for example, a personal profile for a particular customer can include health information 70 such as statistics on the customer's last recorded blood pressure, cholesterol, and body mass index, as well as current prescription information 72. It may also contain a history of the customer's medications and product purchases. The customer's account status 74 in the "perks" program may also be recorded and displayed on the touchscreen devices.

Once the customer is identified, the system is programmed to use the data associated with the customer to tailor products and service offerings for that customer. For example, the touchscreen devices can be used to show OTC interaction challenges presented by the customer's prescription, or to advise the customer of news or upcoming events that may be of particular interest to the customer.

The system is also programmed to check if the customer's data suggest that the store's pharmacist may have health recommendations that particularly relate to that customer. Pharmacist recommendations might include, for example, possible recommendation about drug interactions involving medicine that the customer uses. When the data suggest that the pharmacist may have such a recommendation, the system is programmed to cause the touchscreen device to prompt the health guide to steer the customer to the pharmacist station 40 for consultation with the pharmacist.

The system is also programmed to check if the customer's data suggest that the medical assistant may have health recommendations for the customer. These recommendations might include, for example, a possible recommendation about immunizations or health screenings. When such possibilities are found, the system is programmed to cause the touchscreen devices to steer the customer to the clinic station 36. For example, the screen seen in FIG. 11 includes a prompt 80 for scheduling a new screening.

Similarly, the store's computer system is also programmed to check the customer data and, when warranted, cause the touchscreen devices to display a prompt for the customer to sign-up for a pertinent upcoming community health care event in the flexible workspace 38.

It is preferred that information on a portable touchscreen device such as a health tablet be written with limited jargon, in language that can be easily understood by customer. That way, a store employee using a health tablet will feel comfortable showing and discussing the display with the customer, building common trust.

The Prescription Station

The prescription station 32 preferably includes two separate desks where a filled prescription can be turned over to a customer. As seen in FIGS. 4 and 5, one desk is a traditional desk 84 where a customer has a traditional person-to-person interaction with a pharmacy technician who takes or fills the customer's prescription. The second desk is a "rapid refill" desk 86 with prescription kiosks 90 that a customer can use to identify himself or herself, review his or her prescription and insurance information on-screen, and pay for his or her prescription. To provide good flow, the illustrated prescription desks are adjacent and angled with respect to each other and face the reception desk 30, giving customers at the desks direct line-of-sight to the display 58 above the reception desk where wait times are displayed.

A restricted-access, secure preparation area 94 (best seen in FIGS. 1, 4, and 5) is located behind the desks 84, 86 and is used for storing the materials used for filling a customer's prescription. As is customary, this area includes rows of storage 96 and a work counter 98 where the prescription can be packaged for delivery to the customer.

The two prescription kiosks 90 are positioned at opposite ends of the illustrated rapid refill desk 86 and are separated by an open space 102 through which a technician in the secure preparation area 94 can interact with a customer.

Figure 12:
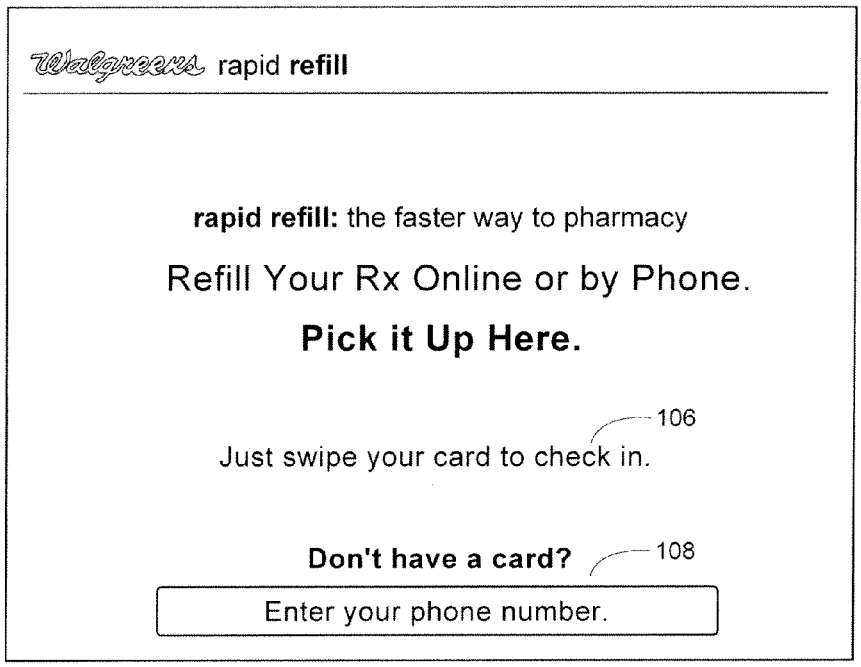
FIG. 12 is a home page screen display on another touchscreen device that can be used in the workspace.
Figure 13:
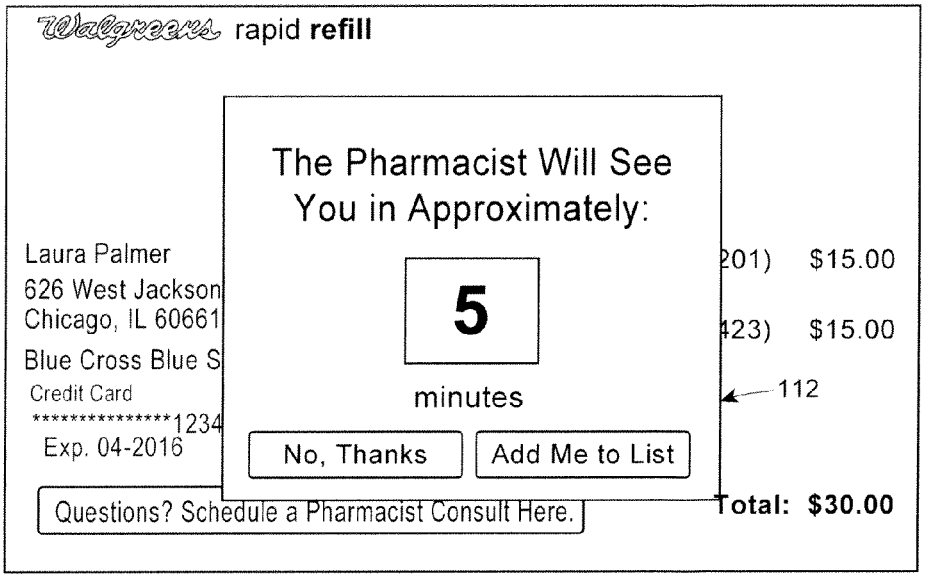
FIG. 13 is an example of another screen display that can be presented on the display seen in FIG. 12.

A customer's check-out process can be completed in as few as three or four clicks on the screen of the prescription kiosk 90. First, a customer using one of the prescription kiosks can identify himself or herself, for example by swiping an identity card or by entering his or her telephone number. FIG. 12 shows one example of an opening screen that could be displayed on the kiosk. It includes a prompt 106 for a customer to swipe an identification card, and a separate instruction 108 that the customer can also identify himself or herself by entering his or her telephone number. Once the individual is identified, the system is programmed to pull up the associated prescription information. A signal can simultaneously be sent to a pharmacist technician in the secure preparation area 94, who can then begin work on processing the customer's prescription. The illustrated prescription kiosk is programmed to display a second screen that confirms the customer's personal information, prescription information, and insurance information, estimates how long it will take for the order to be filled, states the price for filling the order, and asks the customer if he or she wants to proceed. Preferably, the screen also provides the customer with an option 112 for scheduling a consultation with the pharmacist at the pharmacist station 40. An example of such a screen is seen in FIG. 13. If the customer wants to proceed, the next screen can provide payment options. A final screen tells the customer where and when the order can be picked up.

Preferably, the prescription kiosk 90 signals to the technician in the secure preparation area 94 when the customer has paid for the order. Once the payment is made, the technician may reconfirm the customer's identity and then deliver the filled prescription to the customer, completing the process. It is believed that this semi-automated process minimizes labor expenses and provides added convenience to customers. The added convenience may lead to increased prescription loyalty, further increasing profitability.

The Pharmacy Waiting Area

As best seen in FIGS. 1, 4, and 5, the separate pharmacy waiting area 34 off the open circulation area 42 has parallel rows of seating 120, 122 that define front and back limits 124, 126 of a pharmacy seating area 130. In the example seen in FIG. 4, the pharmacy waiting area is an approximately twelve foot wide by twelve foot long space, and the seating area is approximately four feet by eight feet. In the example seen in FIG. 5, the pharmacy waiting area measures approximately thirteen feet, four inches long by twenty feet long, and the seating area is approximately six feet by nine feet. Other sizes and dimensions can also be used, and extra rows of seating can be provided outside this area.

In the examples of a pharmacy waiting area 34 seen in FIGS. 4 and 5, each of the rows of seating 120, 122 consists of side-by-side chairs, with the chairs in each row facing the chairs of the other row and the two rows being separated by a low table 134, such as a coffee table. In the example seen in FIG. 4, each row has two chairs, and the front and back limits 124, 126 of the seating area 130 are approximately eight feet apart. In the example seen in FIG. 5, each row has three chairs, and the front and back limits of the seating area are approximately nine feet apart. In these examples, one row of chairs faces toward the open circulation area 42, while the other row of chairs faces away from the open circulation area. Instead of using rows of side-by-side chairs like those illustrated here, rows of facing chairs or front-to-back chairs could also be used, with one lateral side of each chair facing the open circulation area and the other side of the chair facing away from that area. In those kinds of arrangements, the front limit of the pharmacy seating area is defined by the lateral side of the chairs closest to the open circulation area, and the back limit is defined by the side of the chairs farthest from the open circulation area. In either case, the front and back limits of the pharmacy seating area are arranged on lines that intersect a screening wall 140 that is positioned between the interior of the clinic station 36 and the pharmacy waiting area 34.

The Clinic Station

The illustrated clinic station 36 provides a walk-in clinic that can be used for common acute health issues such as the flu and ear infections. It has one or more examination rooms 142 where screenings and physicals can be performed. Each of the illustrated examination rooms occupies an area of between 85 and 125 square feet of space, and has an examination table 144 and the conventional equipment provided in such rooms.

The clinic station 36 is at least partially surrounded by boundary walls and a doorway 148. The boundary walls around the clinic station illustrated in FIGS. 4 and 5 include the screening wall 140, a back wall 150, a side wall 152, a waiting room wall 154, and a nook wall 156.

The illustrated screening wall 140 seen in FIG. 4 is an approximately seventeen-foot-long segment of an approximately twenty-four-foot-long wall that extends inwardly from an external wall 160 of the store to a front end 162. In the embodiment seen in FIG. 5, the screening wall extends approximately seventeen feet inwardly from a back end 164 to the front end 162. There are no doorways or openings in the screening wall between the two ends of the screening wall. In both examples, the screening wall is a full-height wall, and part of the wall serves as a wall of one of the examination rooms 142.

The illustrated back wall 150 extends from the back end 164 of the screening wall 140. In the arrangement seen in FIG. 5, the back wall is part of the external wall 160 of the store. As seen in the arrangement is FIG. 4, however, this is not necessary. Generally, it will be preferred for the back wall and the screening wall to meet at a right angle, but this will not always be necessary. In the arrangement seen in FIG. 4, the back wall is approximately eighteen feet, nine inches long. In the arrangement seen in FIG. 5, it is approximately eighteen feet, three inches long. In both examples, it is a full height wall that serves as a wall of each examination room 142, but other arrangements can also be used.

The side wall 152 extends inwards from an end of the back wall 150 opposite the back end 164 of the screening wall 140. Generally, it will be preferred for the side wall and the back wall to meet at a right angle, but this will not always be necessary. In both illustrated arrangements, the side wall is one to three feet longer than the screening wall 140, but this is not always necessary. In the arrangement seen in FIG. 4, the side wall is approximately nineteen-and-a-half feet long. In the arrangement seen in FIG. 5, it is approximately eighteen feet long. In both examples, the side wall is a full-height wall and part of it serves as a wall of one of the examination rooms 142. Again, other arrangements are possible.

The waiting room wall 154 extends from an end of the side wall 152 opposite the back wall 150 toward the screening wall 140. Generally, it will be preferred for the waiting room wall and the side wall to meet at a right angle, but again this will not always be necessary. In the arrangement seen in FIG. 4, the waiting room wall is approximately ten feet long. In the arrangement seen in FIG. 5, it is approximately nine feet long.

The waiting room wall 154 ends at one end of the doorway 148. The doorway provides egress between the clinic station 36 and the rest of the workspace 10. Preferably, the doorway adjoins the open circulation area 42, and is indirect line-of-sight of and faces the reception desk 30, providing direct line-of-sight to the display 58 above the reception desk where wait times are displayed. The illustrated doorway is angled with respect to the waiting room wall, but this is not always necessary. In the example seen in FIG. 4, the doorway and the waiting room wall form an angle of around 165 degrees. In the example seen in FIG. 5, the doorway and the waiting room wall form an angle of approximately 140 degrees. Each illustrated doorway is approximately six feet wide.

Figure 7:
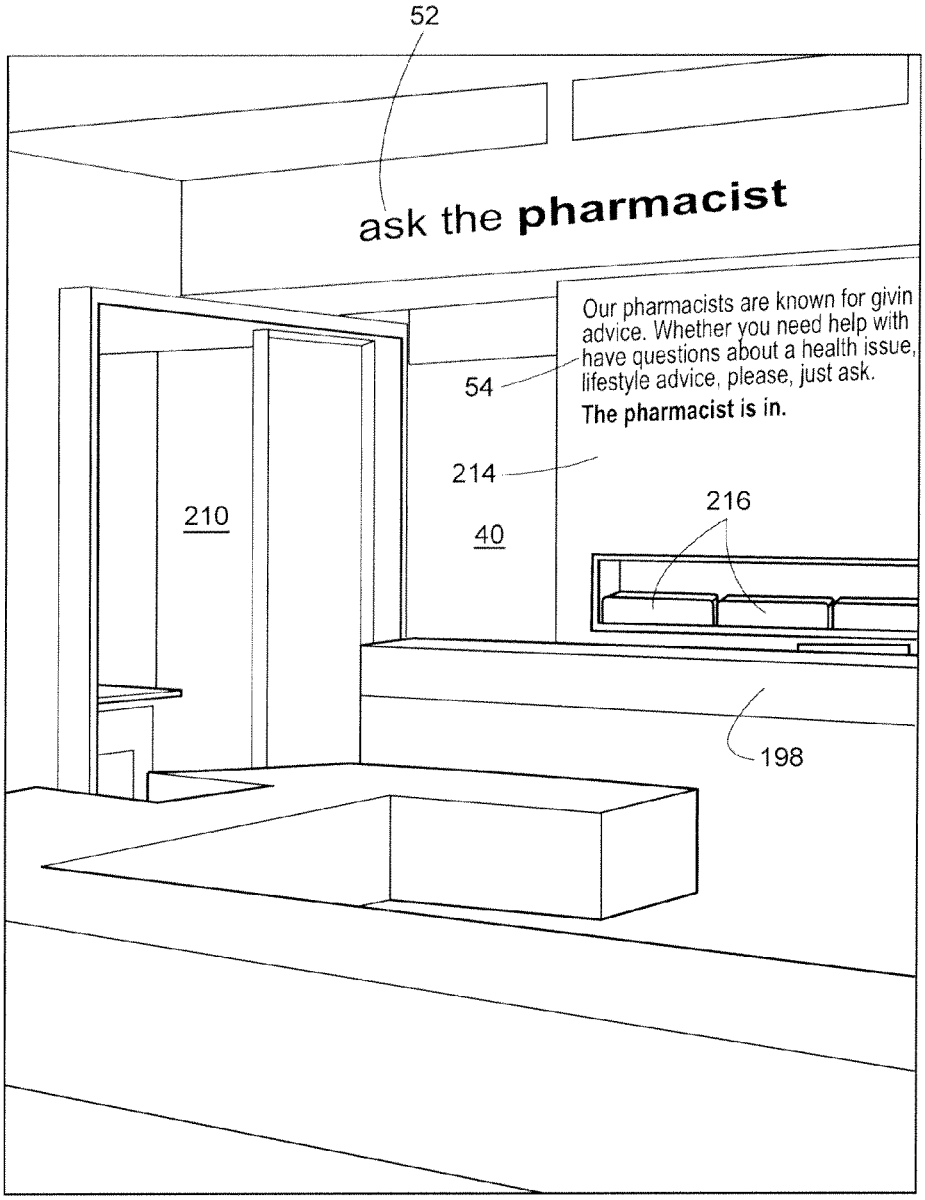
FIG. 7 is a customer-level perspective view of another part of the new workspace.

The nook wall 156 connects the side of the doorway 148 opposite the waiting room wall 154 to the front end 162 of the screening wall 140. Generally, it will be preferred for the nook wall and the screening wall to meet at a right angle, but again this will not always be necessary. Because the illustrated doorways 148 are angled with respect to the waiting room wall, the nook walls seen in FIGS. 6 and 7 are not co-linear with the waiting room walls. Although this arrangement may promote a welcoming feel, in other settings it may be desired to arrange the nook wall so that it is co-linear with the waiting room wall. In both the arrangement seen in FIG. 4 and in the arrangement seen in FIG. 5, the nook wall is approximately three feet long. The illustrated nook wall is a full-height wall, though this is not necessary.

To help customers feel comfortable that visiting the prescription station 32 or waiting for a prescription is unlikely to expose them to a communicable disease, the new workspace 10 provides a clinic waiting room 170 within the boundary walls 140, 150, 152, 154, 156, between the examination rooms 142 and the doorway 148. This clinic waiting room is bounded by the nook wall 156, the doorway, the waiting room wall, segments of the side wall 152 and the screening wall 140 in front of the examination rooms 142, and front walls 174 of the examination rooms. Arranged in this way, with the screening wall separating and isolating the clinic station for the pharmacy waiting area, the clinic waiting room is screened from the pharmacy seating area.

The clinic waiting rooms seen in FIGS. 4 and 5 have an area of between 100 and 150 square feet, and clinic seating 178 to one side of the doorway 148. In the illustrated examples, the seating takes the form of bench seating that extends along the waiting room wall 154 and part of the side wall 152. Other types of seating can also be used.

Figure 14:
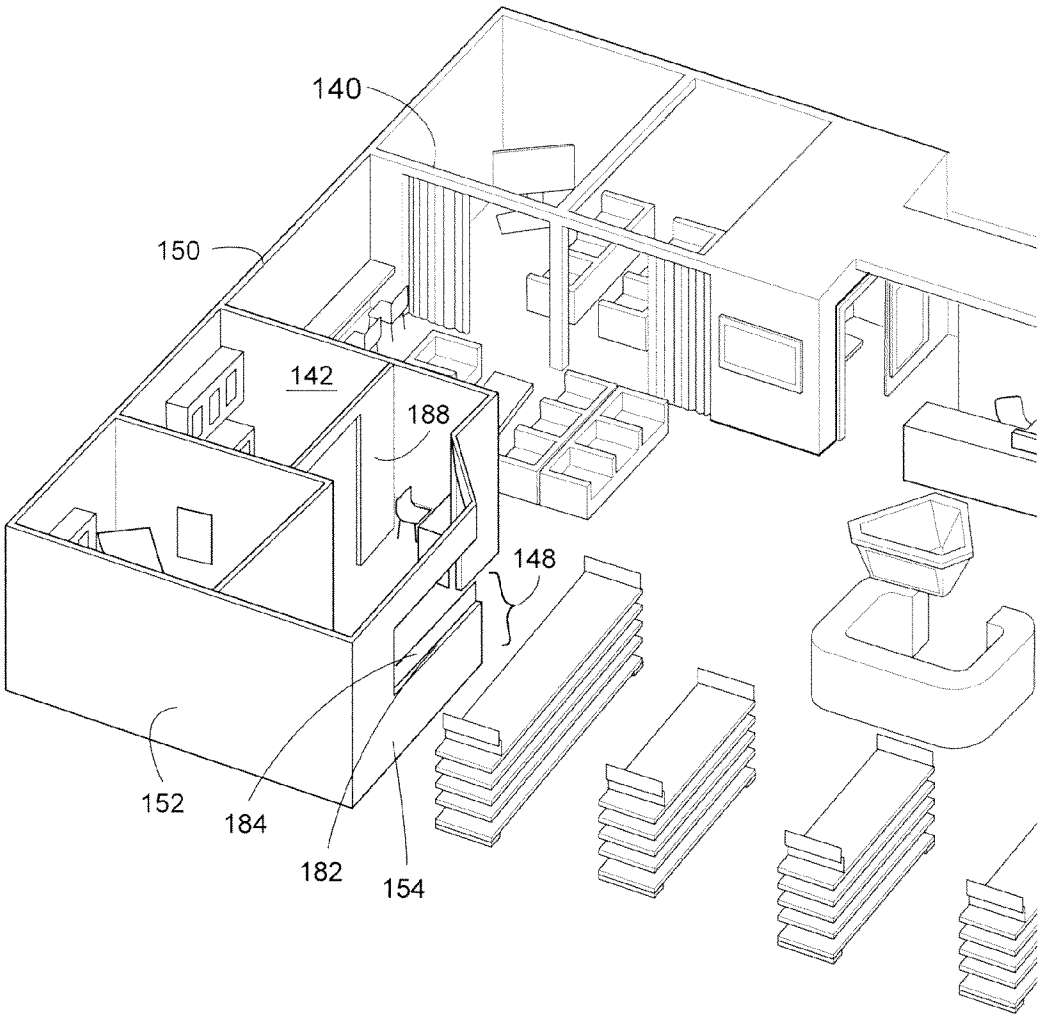
FIG. 14 is an enlarged view of a part of the new workspace seen in FIG. 1.

As seen in FIG. 14, a window 182 can be provided in the waiting room wall 154, extending from an upper part of the doorway 148 and facing the open circulation area 42. The window can be at least partially covered by a non-opaque divider 184. In the examples seen in FIGS. 6 and 7, the window is approximately five to eight feet wide and three to five feet high. The divider extends approximately half way up the height of the window and is made of transparent glass or plastic. This arrangement provides visibility to customers waiting in the clinic waiting room 170, allowing them to see the displays over the reception desk 30 and reducing the chance of them feeling trapped in the space, while simultaneously giving customers in the open circulation area 42 a sense that they are being screened from the customers in the clinic waiting room.

Video-conferencing equipment 186 can also be provided within the clinic waiting room 170, enabling a customer to communicate with an off-site medical specialist. A touch-screen device can also be used there, and programmed to use the data associated with a customer to tailor specific product and service recommendations for that customer.

Services at the clinic station 36 are preferably supervised or performed by a nurse practitioner or similar medical assistant. In smaller stores, the medical assistant can also serve as the health guide.

The medical assistant can be seated in a nook 188 within the clinic waiting room 170. The nook can be positioned on the opposite side of the doorway 148 from the clinic seating 178, and be bounded by part of the screening wall 140 in front of the examination rooms 142 and by the nook wall 156. The illustrated nook is equipped with a medical assistant workstation 190. This workstation enables the medical assistant to accept payment for services and process paperwork for customers being served in the clinic station.

Alternatively, a customer can pay for services performed at the clinic station 36 at an optional traditional check-out register (not shown) at the reception desk 30. For security purposes, customer payment can also be handled in other ways. For example, a credit card-only pay station can be provided at the reception desk, or the customer can be referred to the prescription station 32 for payment, or the customer can be given a card to be taken to the front of the store for payment at the registers there.

Flexible Workspace

The flexible workspace 38 seen in FIG. 6 can be used to host individual or group health and wellness events. These events can be sponsored by the store or by guest specialists or institutions. For example, personal trainers, specialist doctors, pharmacists, and nurse practitioners could all use this space to host special sessions related to health and health care. Alternatively, the flexible workspace 38 can be used for one-on-one coaching or as additional space for crowded activities such as administration of flu shots. Providing more space for such activities can increase throughput and also improve the experience for customers.

For flexibility of use, it is preferred that pharmacy waiting area 34 be located adjacent to the flexible workspace 38, with the pharmacy waiting area positioned between the flexible workspace and the reception desk 30. For effectiveness, it is preferred that the flexible workspace cover at least 120 square feet of floor space. In the arrangement seen in FIG. 4, the flexible workspace measures approximately twelve feet by twelve-and-a-half feet, and is located behind the pharmacy waiting area. In the arrangement seen in FIG. 5, the flexible workspace measures approximately fourteen-and-a-half feet by ten feet, and is located to a side of the pharmacy waiting area.

Information about events taking place in the flexible workspace 38 is available at the reception desk 30, and customers can sign up for and check in for those events at that desk.

Figure 15:
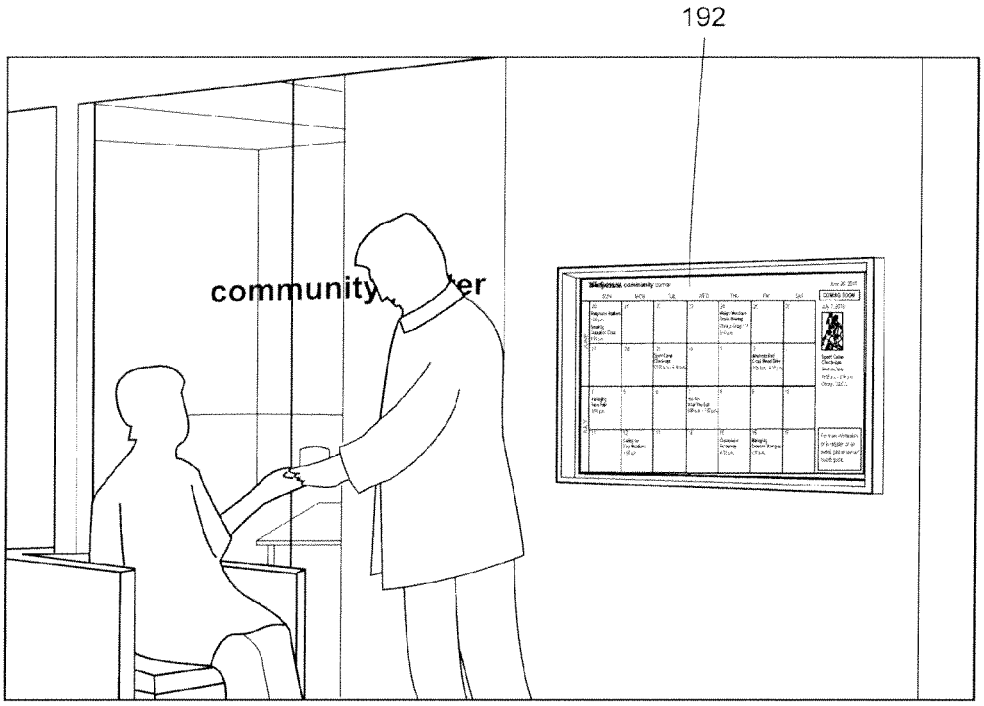
FIG. 15 is a customer-level perspective view of another part of the new workspace.

In the arrangement seen in FIG. 15, a community calendar 192 is provided in or adjacent to the flexible workspace 38. This calendar is preferably provided on a digital screen that coordinates with the displays above the reception desk, and enables customers to view upcoming events that will take place in the flexible workspace as well as elsewhere in the community. An example display is seen in FIG. 16. Marketing messages can also be included on this display.

Kiosks with touchscreen devices of the type described above can also be provided in both the flexible workspace 38 and the pharmacy waiting area 34.

Pharmacist Station

In the new workspace 10, one of the new, alternative ways that a customer can obtain health care information is through one-on-one communications with a pharmacist at the pharmacist station 40, seen in FIG. 7. The pharmacist station is preferably staffed by a pharmacist who is hired for his or her ability and desire to work directly with customers. In the arrangement seen in FIG. 4, the pharmacist station is directly behind the reception desk 30. Pharmacist seating 194 is provided behind a pharmacist desk 198 that borders and directly faces the open circulation area 42. In the arrangement seen in FIG. 5, the pharmacist station is position to the left of the reception desk, and the front edge of the pharmacist desk directly faces not only the open circulation area, but also the reception desk itself. Positioning the pharmacist in a seating position behind a desk that borders the open circulation area enables and encourages the pharmacist to interface directly with customers.

To further enhance the base of knowledge upon which the pharmacist can rely, the illustrated pharmacist station 40 is provided with a health tablet or a kiosk similar to those at the reception desk 30. Preferably, a pharmacist who accesses the tablet or kiosk has access to all the other information available to the health guide. With the pharmacist thus equipped and positioned, customer interactions are expected to lead to deeper customer relationships. This may increase customer loyalty, in particular from chronic patients. Additionally, a relationship-driven approach is expected to increase service sales, front-end trips, and overall lifetime customer value.

Figure 17:
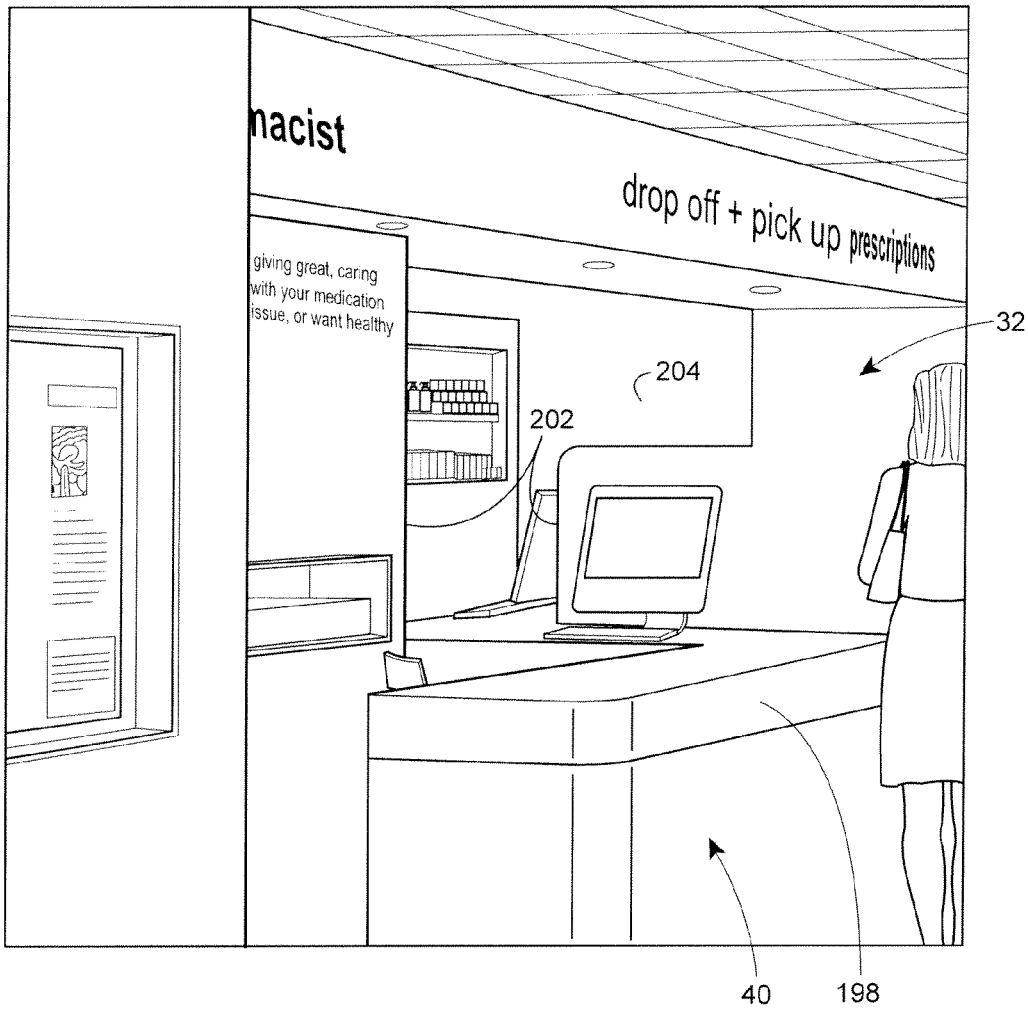
FIG. 17 is a customer-level perspective view of another part of the new workspace.

In both of these examples, the pharmacist station 40 is adjacent the prescription station 32, and a pass-through window 202 seen in FIG. 17 enables a pharmacist at the pharmacist station to interact directly with the restricted-access pharmacy area 204 behind the pharmacy station. This window enables the pharmacist to directly interact with a technician in that restricted-access area, without losing access to customers.

As seen in FIGS. 4 and 5, a private consultation room 210 is arranged across a hallway from the pharmacist desk 198. This room provides a private setting where customers may feel more comfortable in taking discussions beyond medication instruction into life-style challenges and goal setting. The room can also be used as a facility where the pharmacist or a nurse practitioner can provide screenings and immunizations.

As seen in FIG. 7, a rear wall 214 behind the pharmacist desk 198 can be used for displaying the conversational statement 54 about the store's pharmacists and can include bins 216 for storing materials such as handouts that the pharmacist may hand out to customers.

This description of various embodiments of the invention has been provided for illustrative purposes. Revisions or modifications may be apparent to those of ordinary skill in the art without departing from the invention. The full scope of the invention is set forth in the following claims.

The invention claimed is:

1. A retail pharmacy workspace that comprises:

a pharmacy area that includes a prescription preparation area and a prescription station where prescriptions are delivered to customers;

a pharmacy waiting area in direct line-of-sight of the prescription station;

a clinic station where common acute health issues can be addressed;

a clinic waiting room that is disposed within the clinic station between an entrance to the clinic station and an examination room within the clinic station;

a central reception desk that is separated from the clinic station by only an open circulation area;

boundary walls that at least partially surround the clinic station and comprise:

a waiting room wall that extends from one side of the entrance to the clinic station and at least partially defines separate clinic seating within a clinic seating area, a screening wall that separates and isolates the clinic station from the pharmacy waiting area, and a window that is located in the waiting room wall, extends from an upper part of the entrance to the clinic station, is at least partially covered by a non-opaque divider, and faces the open circulation area;

parallel rows of separate pharmacy seating in the pharmacy waiting area that are located adjacent to the screening wall that has no doorway.

2. The retail pharmacy workspace as recited in claim 1, in which:

the clinic station also has video-conferencing equipment that enables a customer to communicate with an off-site medical specialist.

3. The retail pharmacy workspace as recited in claim 1, in which:

the boundary walls also include a nook wall that extends between a front end of the screening wall and the entrance to the clinic station; and the clinic waiting room within the clinic station has a nook that is partially defined by part of the screening wall and by the nook wall, and has separate nook seating for a medical assistant.

4. The retail pharmacy workspace as recited in claim 1, in which:

the clinic waiting room within the clinic station also has a nook that has separate nook seating for a medical assistant.

5. The retail pharmacy workspace as recited in claim 1, in which:

the boundary walls include a nook wall that extends between a front end of the screening wall and a side of the entrance to the clinic station opposite the waiting room wall; and the clinic waiting room within the clinic station has a nook that is partially defined by part of the screening wall and by the nook wall and has separate nook seating for a medical assistant.

6. The retail pharmacy workspace space as recited in claim 1, in which:

the central reception desk is within direct line-of-sight of the prescription station, the pharmacy seating, and the entrance to the clinic station.

7. The retail pharmacy workspace as recited in claim 1, in which:

the central reception desk is positioned between the clinic station and the prescription station; and overhead displays at the reception desk are within direct line-of-sight of the prescription station, the pharmacy seating, and the entrance to the clinic station, on which waiting times are displayed for both prescriptions and services in the clinic station.

8. The retail pharmacy workspace as recited in claim 1, in which:

the central reception desk is positioned between the clinic station and the prescription station; and the reception desk has overhead displays that face the clinic station, the pharmacy waiting area, and the prescription station, on which waiting times are displayed for both prescriptions and services in the clinic station.

9. The retail pharmacy workspace as recited in claim 1, in which:

the clinic station also has a touchscreen device that is programmed to use the data associated with a customer to tailor product and service recommendations for that customer.

10. The retail pharmacy workspace as recited in claim 1, further comprising:

the parallel rows of separate pharmacy seating in the pharmacy waiting area are arranged on lines that intersect a segment of the screening wall that has no doorway.

11. A retail pharmacy workspace that comprises:

a pharmacy area that includes a prescription preparation area and a prescription station where prescriptions are delivered to customers;

a pharmacy waiting area in direct line-of-sight of the prescription station;

a clinic station where common acute health issues can be addressed, the clinic station having a waiting room that is disposed between a doorway to the clinic station and an examination room within the clinic station;

boundary walls that at least partially surround the clinic station and include:

a screening wall that separates and isolates the clinic station from the pharmacy waiting area, a nook wall that extends between an inner end of the screening wall and one side of the doorway to the clinic station, and a waiting room wall that extends from an opposite side of the doorway to the clinic station and is not co-linear with the nook wall;

parallel rows of separate pharmacy seating in the pharmacy waiting area that are located adjacent to the screening wall that has no doorway;

a central reception desk within direct line-of-sight of the prescription station, the pharmacy seating, and the doorway to the clinic station.

12. The retail pharmacy workspace as recited in claim 11, in which:

the waiting room within the clinic station has separate clinic seating within a clinic seating area that is partially defined by the waiting room wall; and the waiting room wall has a window that extends from an upper part of the doorway to the clinic station and is at least partially covered by a non-opaque divider, providing direct line-of-sight from the waiting room to a display near the central reception desk.

13. The retail pharmacy workspace as recited in claim 11, in which:

the central reception desk is positioned between the clinic station and the prescription station.

14. The retail pharmacy workspace as recited in claim 11, further comprising:

the parallel rows of separate pharmacy seating in the pharmacy waiting area are arranged on lines that intersect a segment of the screening wall that has no doorway.

15. A retail pharmacy workspace that comprises:

a pharmacy area that includes a prescription preparation area and a prescription station that has both a prescription counter where prescriptions are delivered to customers and a payment station where payment can be processed;

a pharmacy waiting area in direct line-of-sight with the prescription station;

a clinic station where common acute health issues can be addressed, the clinic station having a waiting room that is disposed between an entrance to the clinic station and an examination room within the clinic station;

a central reception desk that is positioned between the clinic station and the prescription station and is separated from the clinic station by only an open circulation area;

boundary walls that at least partially surround the clinic station, have a doorway that faces the reception desk, and include a screening wall that separates and isolates the clinic station from the pharmacy waiting area, a nook wall that extends between a front end of the screening wall and one side of the doorway, and a waiting room wall that extends from an opposite side of the doorway;

a nook that is located within the waiting room, is partially defined by part of the screening wall and by the nook wall, and has nook seating for a medical assistant;

seating within a clinic seating area that is located within the clinic waiting room and is partially defined by the waiting room wall;

a separate payment station within the clinic station;

a touchscreen device in the clinic station that is programmed to use data associated with a customer to tailor product and service recommendations for that customer;

a window that is located in the waiting room wall, extends from an upper part of the doorway, is at least partially covered by a non-opaque divider, and faces the open circulation area;

overhead displays above the reception desk that face the clinic station, the pharmacy waiting area, and the prescription station, on which waiting times are displayed for both prescriptions and for services in the clinic station;

video-conferencing equipment within the clinic station that enables a customer to communicate with an off-site medical specialist; and parallel rows of separate pharmacy seating in the pharmacy waiting area that are arranged on lines that intersect the screening wall.

* * * * *